US009091473B2

(12) United States Patent
Mitchell

(10) Patent No.: US 9,091,473 B2
(45) Date of Patent: Jul. 28, 2015

(54) FLOAT-TYPE ICE MAKING ASSEMBLY AND RELATED REFRIGERATION APPLIANCE

(75) Inventor: Alan Joseph Mitchell, Louisville, KY (US)

(73) Assignee: General Electric Company, Schenectady, NY (US)

( * ) Notice: Subject to any disclaimer, the term of this patent is extended or adjusted under 35 U.S.C. 154(b) by 1021 days.

(21) Appl. No.: 12/942,354

(22) Filed: Nov. 9, 2010

(65) Prior Publication Data

US 2012/0111041 A1 May 10, 2012

(51) Int. Cl.

| | |
|---|---|
| ***F25C 1/08*** | (2006.01) |
| ***F25C 5/08*** | (2006.01) |
| ***F25C 5/00*** | (2006.01) |

(52) U.S. Cl.

CPC . *F25C 1/08* (2013.01); *F25C 5/005* (2013.01); *F25C 5/08* (2013.01); *F25C 2300/00* (2013.01); *F25C 2301/00* (2013.01); *F25C 2700/02* (2013.01); *F25C 2700/04* (2013.01)

(58) Field of Classification Search

CPC ..... F25C 1/08; F25C 2300/00; F25C 2301/00
USPC ..... 62/137, 344, 351, 354, 347, 3.63
See application file for complete search history.

(56) References Cited

U.S. PATENT DOCUMENTS

| | | | | |
|---|---|---|---|---|
| 2,410,672 | A | 10/1941 | Muffly | |
| 2,672,016 | A | 9/1948 | Muffly | |
| 2,695,502 | A | 11/1950 | Muffly | |
| 2,737,786 | A * | 3/1956 | Lindenberg | 62/527 |
| 2,954,679 | A * | 10/1960 | Blackett | 62/139 |
| 3,390,537 | A * | 7/1968 | Callen | 62/62 |
| 4,003,214 | A * | 1/1977 | Schumacher | 62/340 |
| 4,055,053 | A * | 10/1977 | Elfving et al. | 62/3.63 |
| 4,685,304 | A * | 8/1987 | Essig | 62/68 |
| 5,127,236 | A * | 7/1992 | von Blanquet | 62/135 |
| 5,778,677 | A * | 7/1998 | Hung et al. | 62/3.63 |
| 6,735,959 | B1 * | 5/2004 | Najewicz | 62/3.63 |
| 2010/0126185 | A1 * | 5/2010 | Cho et al. | 62/3.63 |
| 2012/0167596 | A1 * | 7/2012 | Krause et al. | 62/3.2 |

FOREIGN PATENT DOCUMENTS

WO WO 2009078562 A1 * 6/2009

* cited by examiner

*Primary Examiner* — Jonathan Bradford
(74) *Attorney, Agent, or Firm* — Dority & Manning, P.A.

(57) ABSTRACT

An ice making assembly includes a reservoir holding water having a water level, at least one conductor extending into the reservoir below the water level, and a cooling device for cooling the conductor to a temperature sufficient to form an ice cube on the conductor. A heater heats the conductor to a temperature sufficient to harvest the ice cube from the conductor. A dispensing device removes harvested ice cubes from the water. Related refrigeration appliances are disclosed.

19 Claims, 6 Drawing Sheets

FLOAT-TYPE ICE MAKING ASSEMBLY AND RELATED REFRIGERATION APPLIANCE

FIELD OF THE INVENTION

The subject matter disclosed herein relates generally to a float-type ice making assembly with ice harvest assist and to a related refrigeration appliance having such an ice maker.

BACKGROUND OF THE INVENTION

Various ice maker designs have been proposed for refrigeration appliances such as commercial or home refrigerators and/or freezers. In certain ice makers known as float ice makers, ice cubes are formed beneath the surface of chilled water. The water is generally maintained just above the freezing point and elements that are colder than the freezing point are employed to form ice cubes beneath the surface. When the ice is sufficiently formed for harvesting, it floats upward to be removed from the chilled water for storage or dispensing.

If ice cubes are removed from the tank of chilled water when they are made and passed to a holding container in a colder freezer compartment, the ice cubes will naturally get colder. The ice cubes may therefore become harder and cloudy, and individual ice cubes may freeze together or to the sides of the holding container. Some consumers do not find such colder, cloudy ice cubes preferable, and would rather have ice cubes closer to the freezing temperature.

However, in typical refrigeration appliances having refrigerator portions and freezer portions, neither of these portions is typically held at such a temperature near the freezing temperature of water. Accordingly, an improved design would be welcome for a float-type ice maker wherein ice cubes more approximating the freezing temperature of water, and not substantially below such temperature, are made available from a conventional refrigeration appliance without a compartment held at such temperature.

BRIEF DESCRIPTION OF THE INVENTION

Aspects and advantages of the invention will be set forth in part in the following description, or may be obvious from the description, or may be learned through practice of the invention.

According to certain aspects of the disclosure, an ice making assembly includes a reservoir holding water having a water level, at least one conductor extending into the reservoir below the water level, and a cooling device for cooling the conductor to a temperature sufficient to form an ice cube on the conductor. A heater heats the conductor to a temperature sufficient to harvest the ice cube from the conductor. A dispensing device removes harvested ice cubes from the water. Various options and modifications are possible.

According to certain other aspects of the disclosure, an ice making assembly includes a reservoir holding water having a water level, at least one conductor extending into the reservoir below the water level, and a cooling device for cooling the conductor to a temperature sufficient to form an ice cube on the conductor. A heater heats the conductor to a temperature sufficient to harvest the ice cube from the conductor. A scoop removes harvested ice cubes from the water. A separator is located above the reservoir for moving removed ice cubes away from the reservoir while allowing water to drain from the removed ice cubes back into the reservoir. A water source and a water level sensor are employed, the water source providing water to the reservoir when the water level sensor senses that the water level is below a predetermined point. As above, various options and modifications are possible.

According to certain other aspects of the disclosure, a refrigeration appliance with a float ice maker includes a refrigerated cabinet and at least one door, a reservoir holding water having a water level, at least one conductor extending into the reservoir below the water level. A cooling device cools the conductor to a temperature sufficient to form an ice cube on the conductor. A heater heats the conductor to a temperature sufficient to harvest the ice cube from the conductor. A dispensing device removes harvested ice cubes from the water. Again, various options and modifications are possible.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
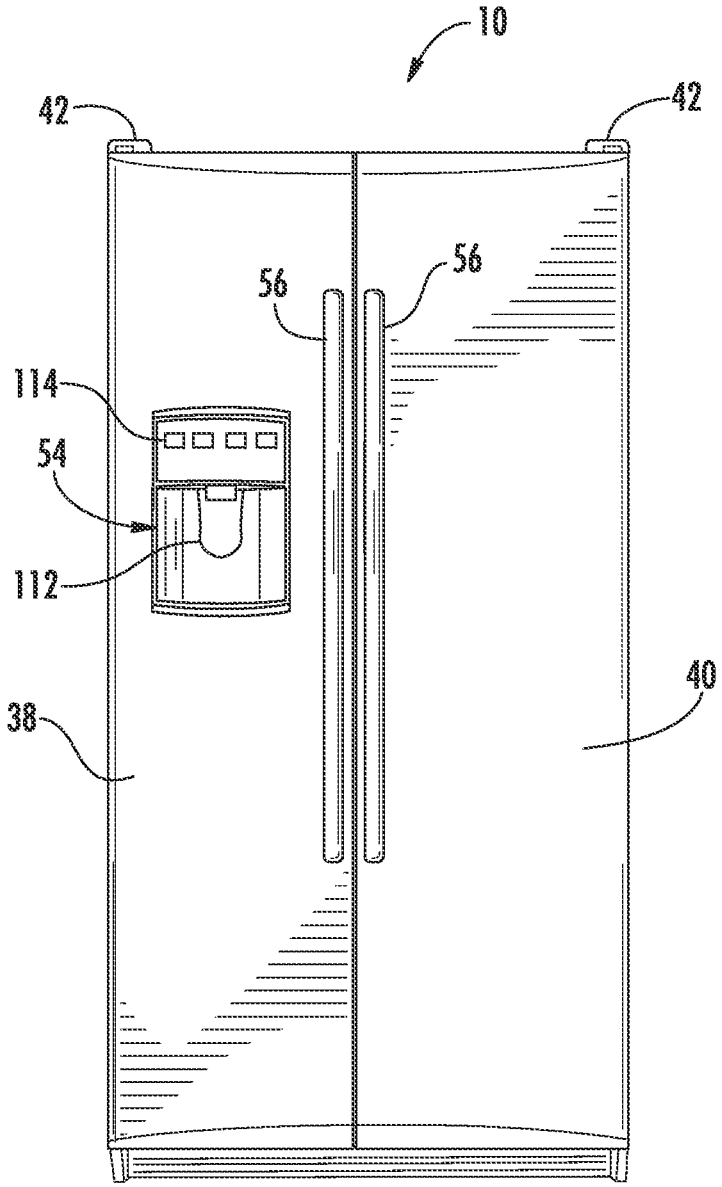
FIG. 1 provides a front view of a refrigeration appliance with its doors closed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a frontal view of an exemplary refrigeration appliance 10 depicted as a refrigerator in which dispenser target indicating assemblies in accordance with aspects of the present invention may be utilized. It should be appreciated that the appliance of FIG. 1 is for illustrative purposes only and that the present invention is not limited to any particular type, style, or configuration of refrigeration appliance, and that such appliance may include any manner of refrigerator, freezer, refrigerator/freezer combination, and so forth. The present disclosure may be especially suitable for a compact refrigerator and/or freezer appliance where space is at a premium and an ice-making capability is desired. However, the disclosed ice-making assembly may be used with any such appliance.

Figure 2:
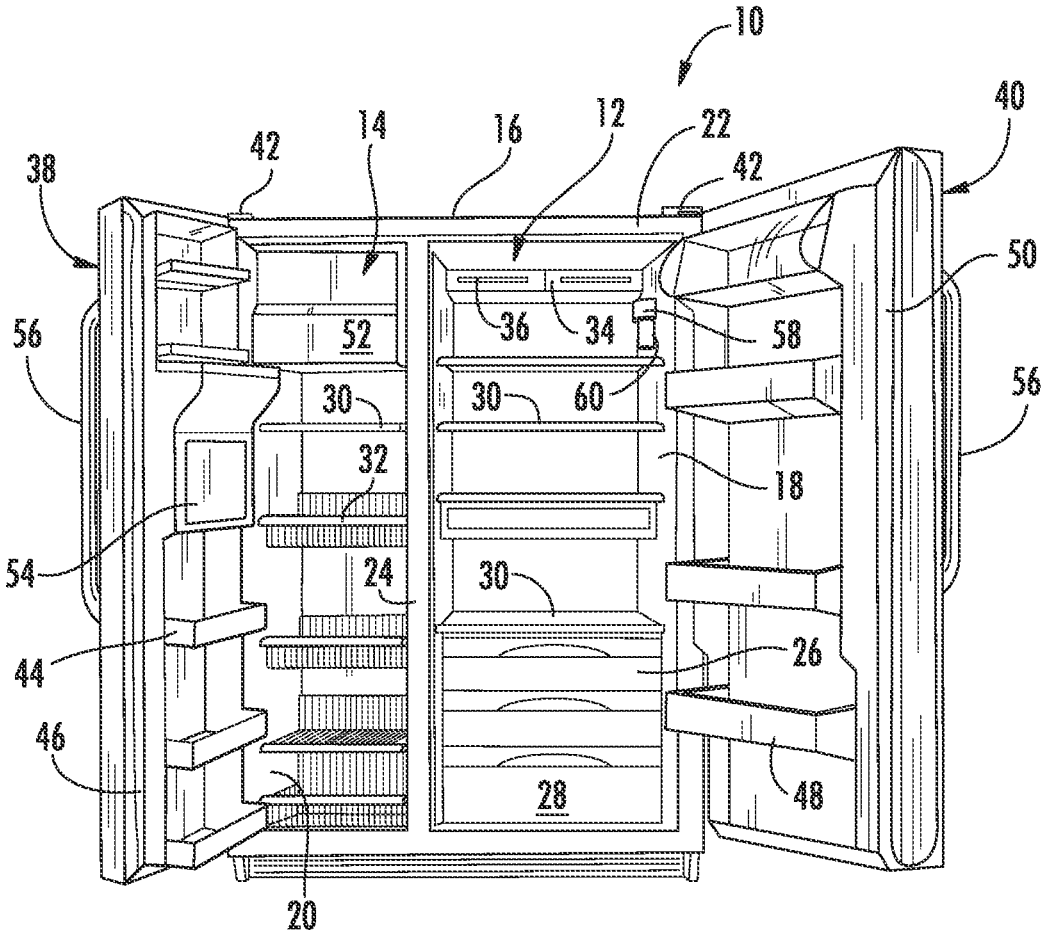
FIG. 2 provides a front view of the refrigeration appliance of FIG. 1 with its doors opened.

Referring to FIG. 2 the refrigerator 10 includes a fresh food storage compartment 12 and a freezer storage compartment 14, with the compartments arranged side-by-side and contained within an outer case 16 and inner liners 18 and 20 generally molded from a suitable plastic material. In smaller refrigerators 10, a single liner is formed and a mullion spans between opposite sides of the liner to divide it into a freezer storage compartment and a fresh food storage compartment. The outer case 16 is normally formed by folding a sheet of a suitable material, such as pre-painted steel, into an inverted U-shape to form top and side walls of the outer case 16. A bottom wall of the outer case 16 normally is formed separately and attached to the case side walls and to a bottom frame that provides support for refrigerator 10.

A breaker strip 22 extends between a case front flange and outer front edges of inner liners 18 and 20. The breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 form a front face, and extend completely around inner peripheral edges of the outer case 16 and vertically between inner liners 18 and 20.

Slide-out drawers 26, a storage bin 28 and shelves 30 are normally provided in fresh food storage compartment 12 to support items being stored therein. In addition, at least one shelf 30 and at least one wire basket 32 are also provided in freezer storage compartment 14.

The refrigerator features are controlled by a controller 34 according to user preference via manipulation of a control interface 36 mounted in an upper region of fresh food storage compartment 12 and coupled to the controller 34. As used herein, the term "controller" is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

A freezer door 38 and a fresh food door 40 close access openings to freezer storage compartment 14 and fresh food storage compartment 12. Each door 38, 40 is mounted by a top hinge 42 and a bottom hinge (not shown) to rotate about its outer vertical edge between an open position, as shown in FIG. 1, and a closed position. The freezer door 38 may include a plurality of storage shelves 44 and a sealing gasket 46, and fresh food door 40 also includes a plurality of storage shelves 48 and a sealing gasket 50.

The freezer storage compartment 14 may include an automatic ice maker 52 and a dispenser 54 provided in the freezer door 38 such that ice and/or chilled water can be dispensed without opening the freezer door 38, as is well known in the art. Doors 38 and 40 may be opened by handles 56 as is conventional. A housing 58 may hold a water filter 60 used to filter water for the ice maker 52 and/or dispenser 54.

As with known refrigerators, the refrigerator 10 also includes a machinery compartment (not shown) that at least partially contains components for executing a known vapor compression cycle for cooling air. The components include a compressor, a condenser, an expansion device, and an evaporator connected in series as a loop and charged with a refrigerant. The evaporator is a type of heat exchanger which transfers heat from air passing over the evaporator to the refrigerant flowing through the evaporator, thereby causing the refrigerant to vaporize. The cooled air is used to refrigerate one or more refrigerator or freezer compartments via fans. Also, a cooling loop can be added to directly cool the ice maker to form ice cubes, and a heating loop can be added to help remove ice from the ice maker. Collectively, the vapor compression cycle components in a refrigeration circuit, associated fans, and associated compartments are conventionally referred to as a sealed system. The construction and operation of the sealed system are well known to those skilled in the art.

Figure 3:
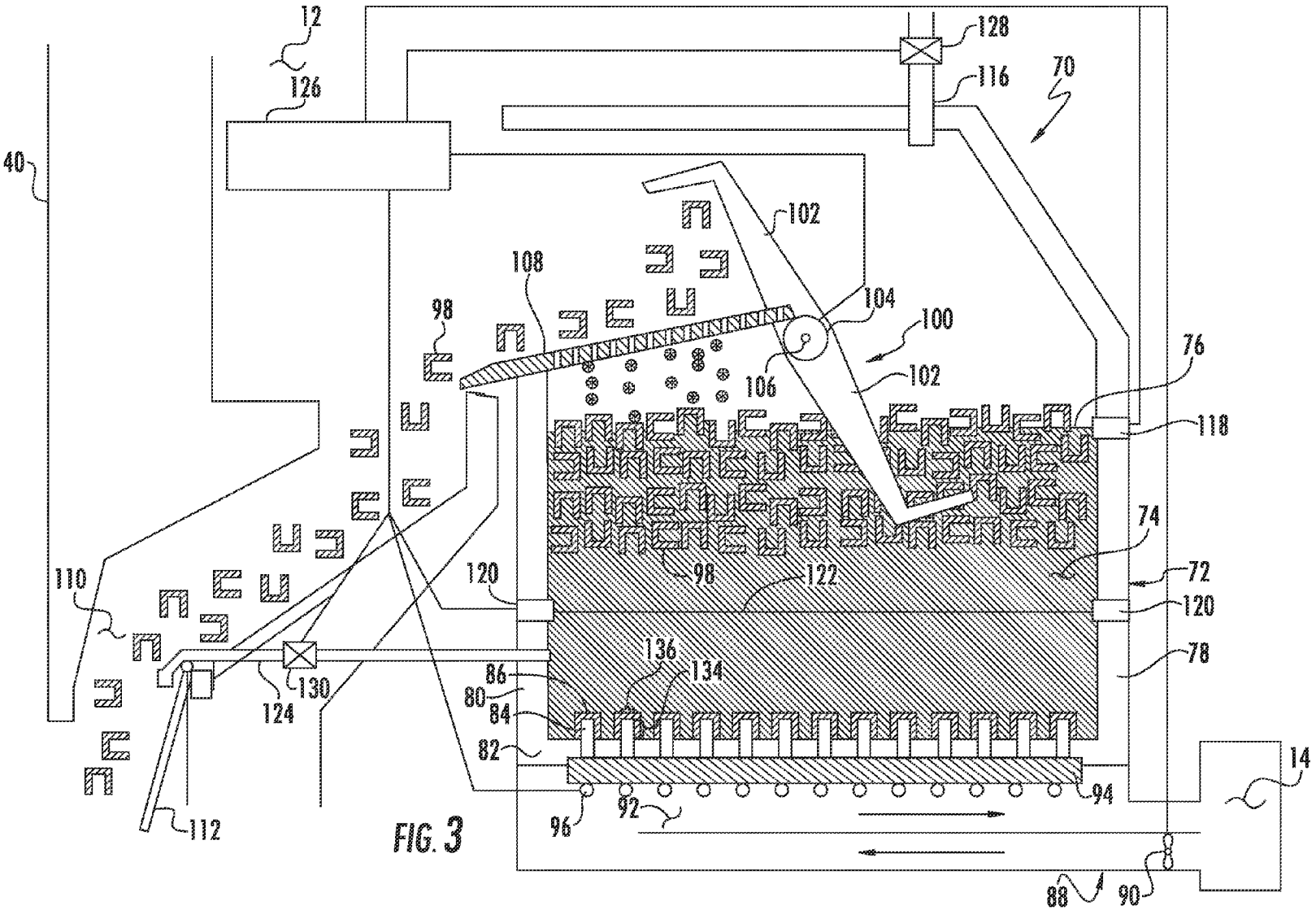
FIG. 3 provides a diagrammatical side view of an ice making assembly according to certain aspects of the present disclosure mounted within a refrigerated compartment such as a refrigerator.
Figure 4:
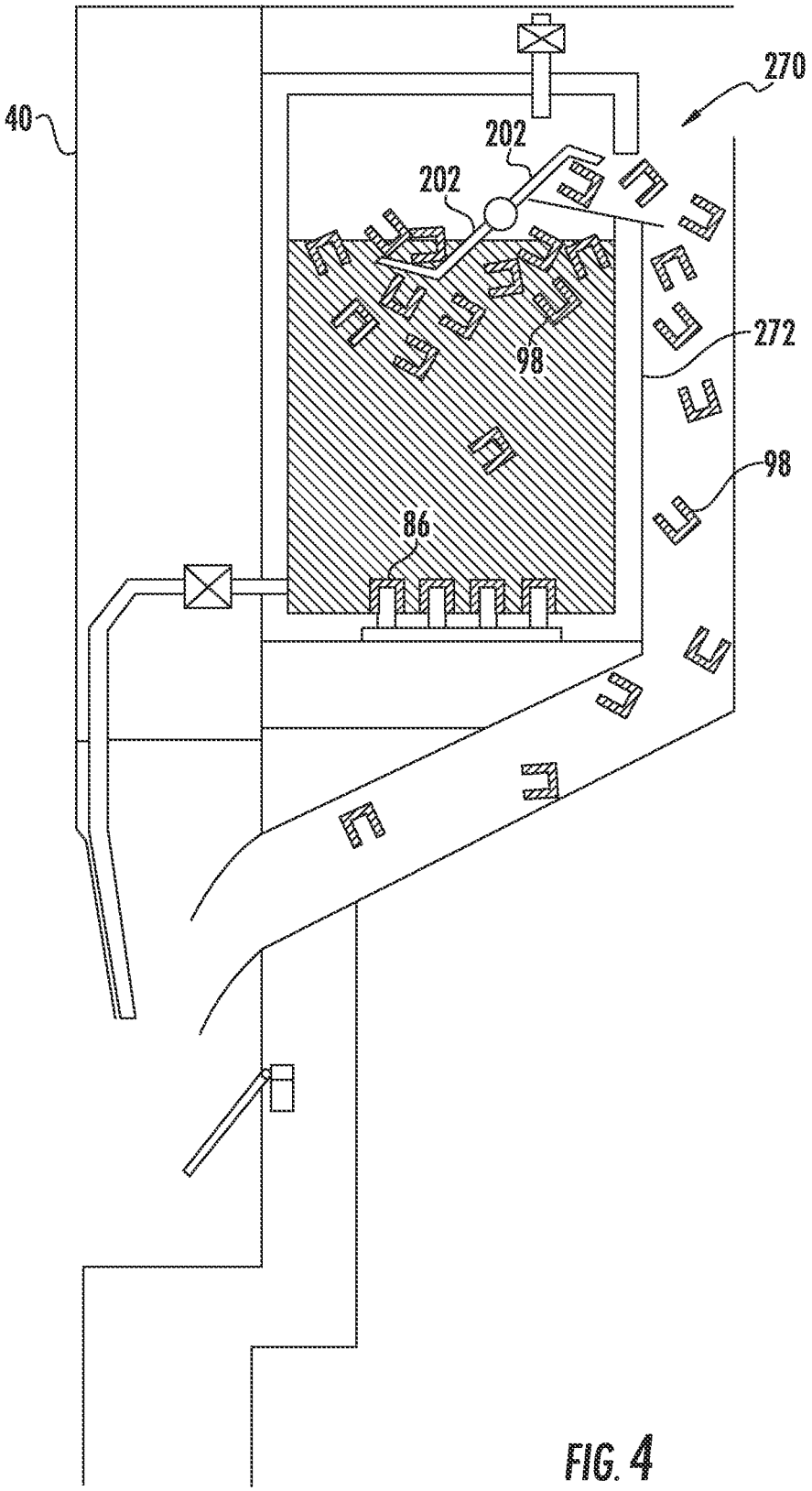
FIG. 4 provides a diagrammatical side view of an ice making assembly according to certain other aspects of the present disclosure mounted within a refrigerated compartment door, such as a refrigerator door.
Figure 5:
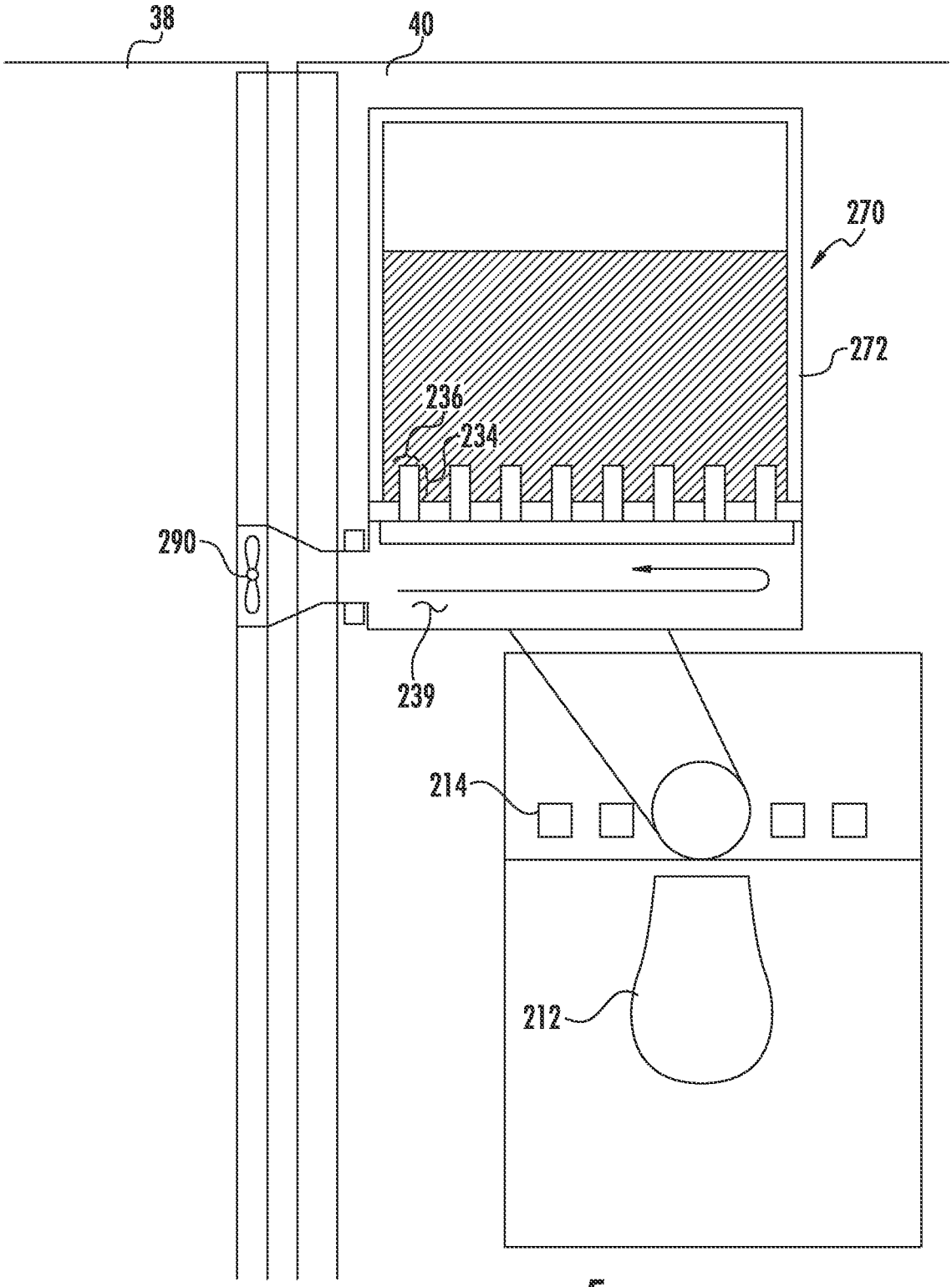
FIG. 5 provides another diagrammatical front view of an ice making assembly according to FIG. 4.
Figure 6:
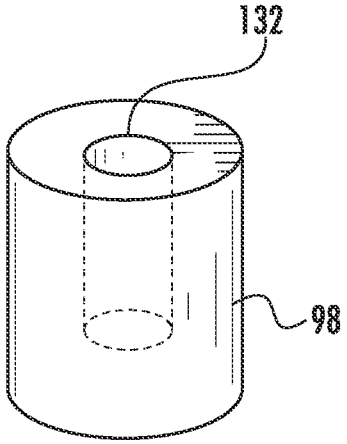
FIG. 6 provides a perspective of a cup-shaped ice cube that can be made using the assemblies of FIGS. 3-5.

FIGS. 3-5 show various example of an ice making assemblies according to different aspects of the invention for making a soft, cup-shaped ice cube as shown in FIG. 6. The "soft ice" formed is stored in a water bath near the freezing temperature for ready dispensing to a user. Such soft ice is often desired by consumers as it is generally visibly clearer than and not as hard as ice maintained at a temperature well below the freezing point, as in some freezers.

More particularly, as shown in FIG. 3, ice making assembly 70 could comprise a device such as ice maker 52 as shown above or could comprise a device in another location or refrigeration appliance. Ice making assembly 70 includes a reservoir 72 holding water 74 having a water level 76. Reservoir 72 has side walls 78,80 and a bottom wall 82. As shown, ice making assembly 70 is mounted within fresh food storage (refrigerator) compartment 12 near door 40, but not mounted to the door so as to move with the door when it is opened.

At least one conductor 84 extends into reservoir 72 below water level 76. As shown, a row of such conductors 84 is visible along bottom wall 82. If desired, multiple rows could be provided in a grid format. Such conductors 84 could also or alternatively be located at other places within reservoir 72, such as along side walls 78,80, as long as the conductors are below water level 76. Conductors 84 may be rod-shaped, so as to form a cup-shaped ice cube 86, as discussed below.

A cooling device 88 cools the conductors 84 to a temperature sufficient to form an ice cube on each of the conductors. As shown, cooling device 88 may include a fan 90 blowing cold air from freezer storage compartment 14 along passageway 92 past conductors 84. Cooling device 88 could be alternately be a cooling plate (cooled by refrigerant) in contact with conductors directly or indirectly, etc. Structure 94 could be provided to thermally link conductors 84 as well. Therefore, any suitable cooling device could be used, and the type of cooling device chosen may depend on where within the refrigeration appliance (i.e., refrigerator or freezer compartment, refrigerator or freezer door, etc.) the reservoir 72 is located. Reservoir 72 may be cooled by cooling device 88 or an additional cooling device (not shown), or simply by virtue of its location within a refrigerated compartment or freezer, to a chilled temperature above the freezing point of water but not so far above that ice cubes melt rapidly in the reservoir. If reservoir 72 were mounted in a freezer, it might be necessary to heat the reservoir slightly to prevent all water 74 in it from freezing. Therefore, maintaining the water within reservoir 72 at a temperature no more than a few degrees above 32° F. would likely be acceptable.

A heater 96 may be provided to heat the conductors 84 to a temperature sufficient to harvest the ice cubes 86 from the conductors, allowing them to float upward to become ice cubes 98 ready for harvest. As shown, heater 96 includes a number of electrical resistance strips temporarily energized when harvest is desired to raise the temperature of conductors 84 just enough to free ice cubes 86 thereon, allowing them to float upward. Other heating sources, such as warm refrigerant or warm air generated by the refrigerant cycle, could be provided.

A dispensing device 100 removes harvested ice cubes 98 from water 74. As shown, dispensing device 100 includes a scoop having at least one arm 102 driven by a motor 104 about an axle 106. Arms 102 scoop up formed ice cubes 98 from water 74 and deposit them on a separator 108 having drain openings therein sized to let water drip off scooped ice cubes back into reservoir 72 as ice cubes move toward a dispensing opening 110. Separator 108 may be formed as a plate, a grate, etc, and may be slanted downward toward dispensing opening 110 so that scooped ice cubes move toward the opening via gravity. A trigger, such as a mechanical paddle handle 112, a user input device such as a touch screen or a button 114 (see FIG. 1), or a combination of elements, could be manipulated by a user to cause the arm 102 to scoop ice cubes 98.

Accordingly, an ice cube 98 can be provided directly to a user as "soft ice" maintained in a cold water bath just above freezing, which is desired by many consumers. Alternatively, the ice cubes could be provided to a container such as an ice bucket maintained in a freezer compartment, either all the time or selectively via a movable diverter or the like (not shown). Thus, various options are possible for dispensing ice cubes formed in the reservoir.

If desired, a water source 116 and a water level sensor 118 may be provided. Water source 116 provides water to reservoir 72 when water level sensor 118 senses that the water level 76 is below a predetermined point. Also, an ice cube level sensor 120 such as an optical sensor can be provided for sensing a level 122 of ice cubes 98 in reservoir 72. Cooling device 88 may be prevented from forming ice cubes 86 on conductor 84 when the ice cube level sensor 120 senses that the level of ice cubes 122 in reservoir 72 is above a predetermined amount. If desired, a chilled water outlet 124 may be provided in communication with reservoir 72 for dispensing chilled water.

If desired, a dedicated controller 126 or controller 34 may be employed to control the various elements mentioned above. Valves 128 and 130 may be provided for water source 116 and outlet 124 as well.

Accordingly, during normal operation of ice making assembly 70, starting with a reservoir of water with no ice, the controller monitors signals from sensors 118 and 120, as well as user input devices 112 and 114, etc. If reservoir 72 is not full per sensor 118, controller causes valve 128 to open until sensor 118 detects that water level 76 has reached the sensor. If sensor 120 does not detect ice down to that level 122, ice making commences by cooling conductors 84. Periodically, heater 96 is initiated by the controller to free ice cubes 86 to float upward. This cycle continues until sensor 120 senses that the quantity of ice cubes 98 in reservoir 72 is sufficient to be sensed by sensor 120. At this point, cooling of conductors 84 stops until ice is removed or melts sufficiently that sensor 120 does not detect ice any longer. If a user wishes to receive ice cubes or water, input devices 112,114, etc are employed. Arm 102 is rotated by controller or valve 130 is operated to provide the desired substance (ice or water). After dispensing is completed, the controller evaluates signals from sensors 118 and 120 as to whether to add water to reservoir 72 and/or start or continue making ice cubes on conductors 84. As mentioned above, ice could be harvested by arm 102 and sent to an alternate location (such as an ice bucket in a freezer compartment) either upon user indication, periodically, or as a default if desired as an option.

Conductors 84 may be made in rod-shaped form so as to create a substantially cup-shaped ice cube (see ice 86 being formed in FIG. 3 and resultant ice cube 98 in FIG. 6.) The term "ice cube" as used herein therefore does not refer strictly to a cube of ice; rather it refers to an individual piece of ice. The pieces of ice formed by the device disclosed herein, if a rod-shaped conductor is used, are somewhat cup shaped. That is, ice cube 98 is substantially cylindrical with a smaller diameter hole 132 part of the way through, corresponding to the shape of the conductor 84. To form such an ice cube, conductors 84 may extend into reservoir 72 with a length 134 no more than three times its width 136. However, other conductor shapes could be employed, whether cylindrical with different ratios, or other shapes entirely.

FIGS. 4 and 5 show an alternate ice making assembly 270 substantially similar to assembly 70, but located on refrigeration compartment door 40. Ice cubes 98 follow a path behind reservoir 272 after being scooped by arms 202. Cooling device such as fan 290 blows cold air from the freezer compartment though an openable passage 239 between doors 38,40. Input devices 212, 214 trigger the providing of chilled water or ice as above. Other than mounting of reservoir 272 in door 40 rather than in compartment 14, the structure and operation of ice making assembly 270 is the same as ice making assembly 70 above.

Accordingly, the devices disclosed above provide a reliable source of ice cubes in a shape often desired by consumers, and in a desirable soft ice form. The systems can be configured and controlled in various optional ways, and can also be connected to a chilled water system as well. The systems can be placed partially or wholly within a freezer, refrigerator and/or door of either, as desired.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly comprising:

a reservoir holding water having a water level;

at least one conductor extending into the reservoir below the water level;

a cooling device for cooling the conductor to a temperature sufficient to form an ice cube on the conductor, the cooling device comprising a passageway positioned adjacent the at least one conductor and a fan operable to blow chilled air through the passageway in order to cool the at least one conductor with the chilled air, the chilled air having a temperature less than the freezing temperature of water during operation of the ice making assembly such that the chilled air cools the at least one conductor to a temperature less than the freezing temperature of water, the at least one conductor extending continuously from the passageway into the reservoir such that thermal conduction of the at least one conductor is uninterrupted between the passageway and the reservoir;

a heater for heating the conductor to a temperature sufficient to harvest the ice cube from the conductor; and a dispensing device for removing harvested ice cubes from the water.

2. The ice making assembly of claim 1, further including a water source and a water level sensor, the water source providing water to the reservoir when the water level sensor senses that the water level is below a predetermined point.

3. The ice making assembly of claim 1, further including an ice cube level sensor for sensing a level of ice cubes in the reservoir, the cooling device being prevented from forming an ice cube on the conductor when the ice cube level sensor senses that the level of ice cubes in the reservoir is above a predetermined amount.

4. The ice making assembly of claim 1, further including a chilled water outlet in communication with the reservoir for dispensing chilled water.

5. The ice making assembly of claim 1, wherein the dispensing device includes a scoop for removing ice cubes from water in the reservoir.

6. The ice making assembly of claim 5, further including a separator located above the reservoir for moving removed ice cubes away from the reservoir while allowing water to drain from the removed ice cubes back into the reservoir.

7. The ice making assembly of claim 5, further including a trigger operable by a user, operation of the trigger by the user causing the scoop to remove ice cubes from the water in the reservoir and provide it to the user.

8. The ice making assembly of claim 7, wherein the trigger is a mechanical paddle assembly.

9. The ice making assembly of claim 1, wherein the reservoir is configured for attachment to the door of a refrigeration appliance.

10. The ice making assembly of claim 1, wherein the reservoir is configured for attachment to the cabinet of a refrigeration appliance.

11. An ice making assembly comprising:

a reservoir holding water having a water level;

at least one conductor extending into the reservoir below the water level;

a cooling device for cooling the conductor to a temperature sufficient to form an ice cube on the conductor, the cooling device comprising a passageway and a fan, the at least one conductor extending from the passageway into the reservoir below the water level, the fan operable to circulate chilled air within the passageway in order to cool the at least one conductor with the chilled air, the chilled air having a temperature less than the freezing temperature of water during operation of the ice making assembly such that the Chilled air cools the at least one conductor to a temperature less than the freezing temperature of water, the at least one conductor extending continuously from the passageway into the reservoir such that thermal conduction of the at least one conductor is uninterrupted between the passageway and the reservoir;

a heater for heating the conductor to a temperature sufficient to harvest the ice cube from the conductor;

a scoop for removing harvested ice cubes from the water;

a separator located above the reservoir for moving removed ice cubes away from the reservoir while allowing water to drain from the removed ice cubes back into the reservoir; and a water source and a water level sensor, the water source providing water to the reservoir when the water level sensor senses that the water level is below a predetermined point.

12. The ice making assembly of claim 11, further including an ice cube level sensor for sensing a level of ice cubes in the reservoir, the cooling device being prevented from forming an ice cube on the conductor when the ice cube level sensor senses that the level of ice cubes in the reservoir is above a predetermined amount.

13. The ice making assembly of claim 12, further including a trigger operable by a user, operation of the trigger the user causing the scoop to remove ice from the water in the reservoir and provide it to the user.

14. A refrigeration appliance with a float ice maker comprising:

a refrigerated cabinet and at least one door, the refrigerated cabinet defining a freezer chamber;

a reservoir holding water having a water level;

at least one conductor extending into the reservoir below the water level;

a cooling device for cooling the conductor to a temperature sufficient to form an ice cube on the conductor, the cooling device comprising a passageway and a fan, the passageway extending from the freezer chamber to the at least one conductor, the fan operable to urge chilled air from the freezer chamber to the at least one conductor in order to cool the at least one conductor with the chilled air such that the chilled air cools the at least one conductor to a temperature less than the freezing temperature of water, the at least one conductor extending continuously from the passageway into the reservoir such that thermal conduction of the at least one conductor is uninterrupted between the passageway and the reservoir;

a heater for heating the conductor to a temperature sufficient to harvest the ice cube from the conductor; and a dispensing device for removing harvested ice cubes from the water.

15. The refrigeration appliance of claim 14, wherein the dispensing device includes a scoop for removing ice cubes from water in the reservoir.

16. The refrigeration appliance of claim 15, further including a separator located above the reservoir for moving removed ice cubes away from the reservoir while allowing water to drain from the removed ice cubes back into the reservoir.

17. The refrigeration appliance of claim 16, further including a trigger operable by a user, operation of the trigger the user causing the scoop to remove ice cubes from the water in the reservoir and provide it to the user.

18. The refrigeration appliance of claim 14, wherein the reservoir is attached to the door.

19. The refrigeration appliance of claim 14, wherein the reservoir is attached to the refrigerated cabinet.

* * * * *